US005579545A

United States Patent [19]

Beard

[11] Patent Number: 5,579,545

[45] Date of Patent: Dec. 3, 1996

[54] COMBINED FOOT SUPPORT AND GROOMING NEEDS HOLDER

[75] Inventor: Janeen E. Beard, 229 Maple Ave., Newport, R.I. 02840

[73] Assignee: Janeen E. Beard, Newport, R.I.

[21] Appl. No.: 435,861

[22] Filed: May 5, 1995

[51] Int. Cl.[6] ..... A47K 3/022

[52] U.S. Cl. ..... 4/574.1; 4/559

[58] Field of Search ..... 4/559, 571.1, 574.1, 4/578.1, 579

[56] References Cited

U.S. PATENT DOCUMENTS

| | | | |
|---|---|---|---|
| D. 287,075 | 12/1986 | Colin et al. . | |
| 1,265,609 | 5/1918 | Carry . | |
| 1,272,936 | 7/1918 | Frazzano | 4/574.1 |
| 2,167,795 | 8/1939 | Bentz | 4/574.1 |
| 2,576,883 | 11/1951 | Koski . | |
| 2,818,577 | 1/1958 | Kubik et al. . | |
| 3,275,283 | 9/1966 | Rauch . | |
| 4,100,628 | 7/1978 | Franzl | 45/579 |
| 4,489,448 | 12/1984 | Cairo | 4/574.1 |
| 5,340,070 | 8/1994 | Soma | 4/574.1 X |
| 5,341,528 | 8/1994 | Sultzbaugh | 4/574.1 X |

*Primary Examiner*—Charles E. Phillips

[57] ABSTRACT

A combined foot support and grooming needs holder device, designed to securely provide elevation and support for a human foot and grooming needs, while washing, drying, pedicuring the foot or shaving the leg, for use inside or outside of the shower or bath tub. The present invention consists of a two-part single legged elongate support member and a two-part platform, so that the human foot and grooming needs may be located near each other while in use.

1 Claim, 3 Drawing Sheets

COMBINED FOOT SUPPORT AND GROOMING NEEDS HOLDER

BACKGROUND OF THE INVENTION

1. Field

The invention is in the field of foot support devices, for use when washing, drying, or pedicuring a foot, in or out, of shower stalls or bath tubs.

2. State of the Art

Proper foot elevation and support, to help maintain balance for a human while washing, drying, pedicuring the foot or shaving leg has not been overlooked. U.S. Pat. Nos. 1,265,609, 1,272,936, 2,576,883, 2,818,577, D287,075, 3,275,283, D340,508 and 4,489,448 are all examples of such prior art. Although these inventions may fit the purpose to which they address, they would not be as suitable for the purposes of the present invention as previously described.

SUMMARY OF THE PRESENT INVENTION

The present invention consists of a binary, or two-part, platform, and a two-part, single legged, elongate support member.

Accordingly, it is an object of the present invention to be modest in size.

Another object is to provide comfortable and sturdy accommodations, for the foot and applicable grooming needs, for the user of the present invention.

Another object is to allow the user of the present invention, convenient accessibility to his/her applicable grooming needs.

It is yet another object, to provide the user the option of adjusting the present invention for left or right-handed use.

It is yet another object of the present invention to allow for and adapt to, various height adjustments.

A BRIEF DESCRIPTION OF DRAWINGS

Other objects and features of the present invention will become apparent from the following description, taken together with the accompanying drawings, in which.

DETAILED DESCRIPTION OF INVENTION

Figure 1:
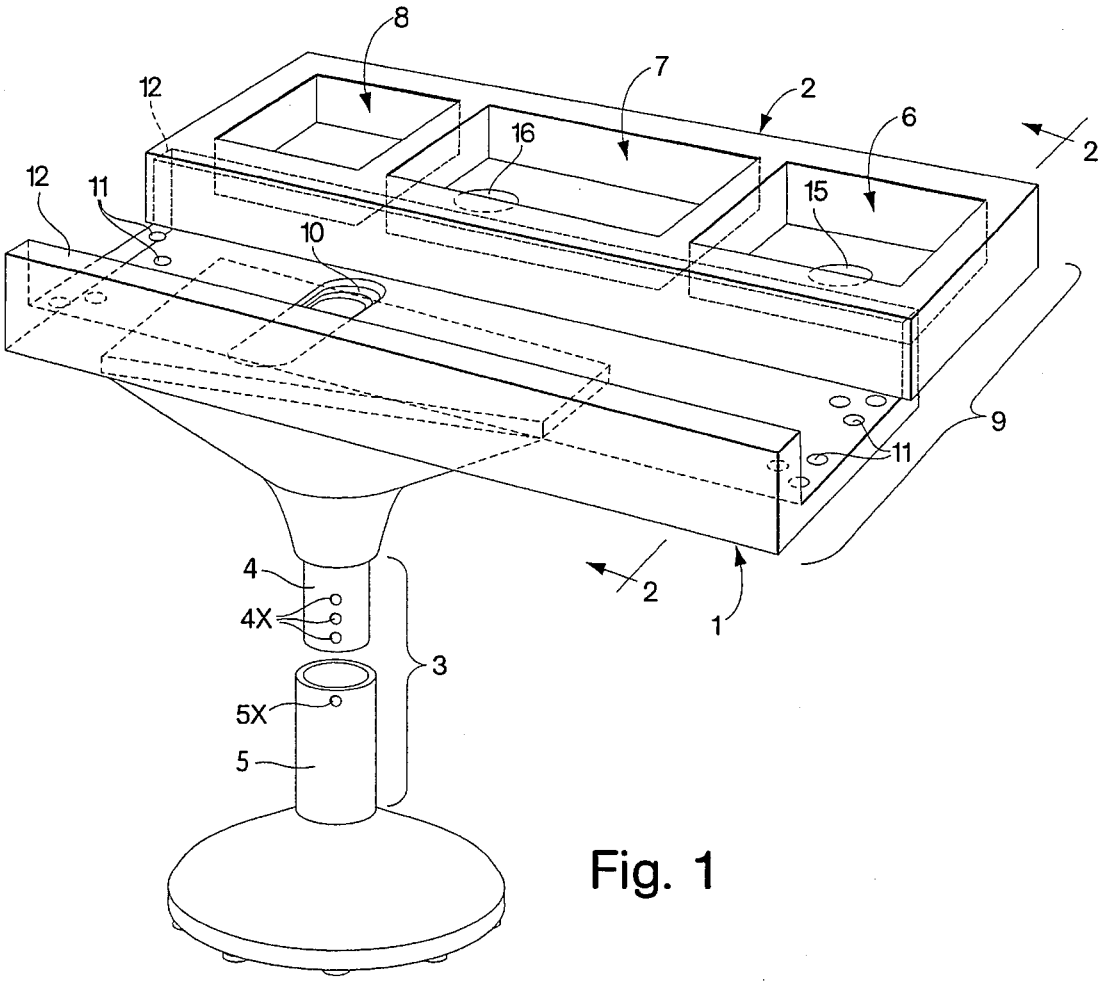
FIG. 1 is a perspective view of the present invention.
Figure 2:
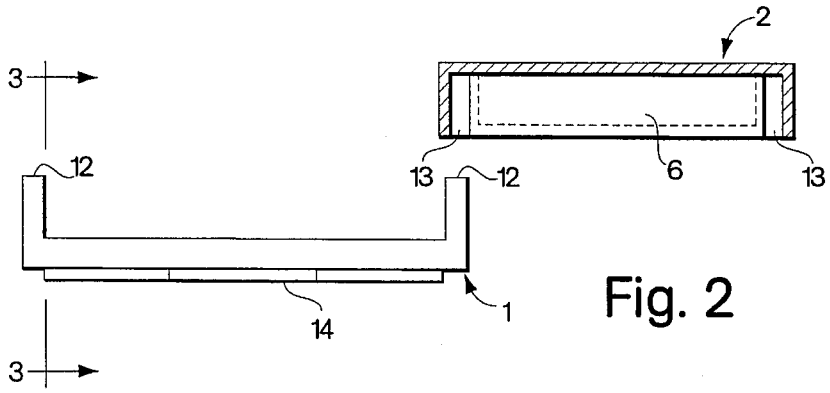
FIG. 2 is a transverse section of trays detached.
Figure 3:
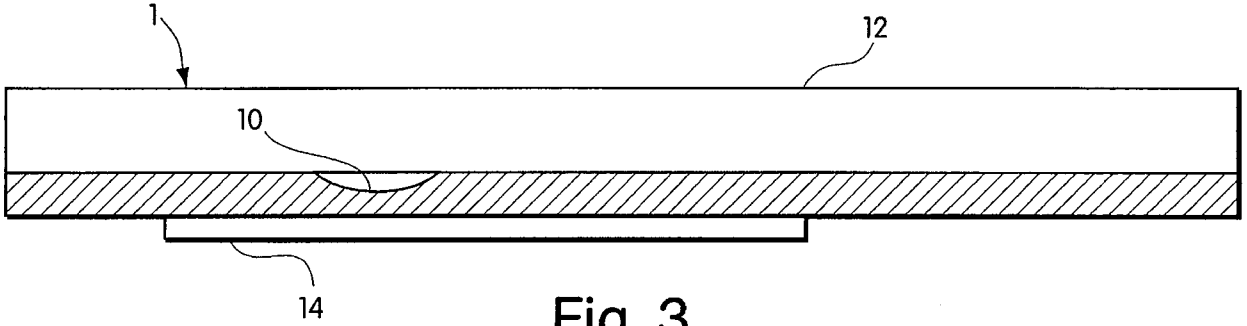
FIG. 3 is a longitudinal vertical section of the primary tray.
Figure 5:
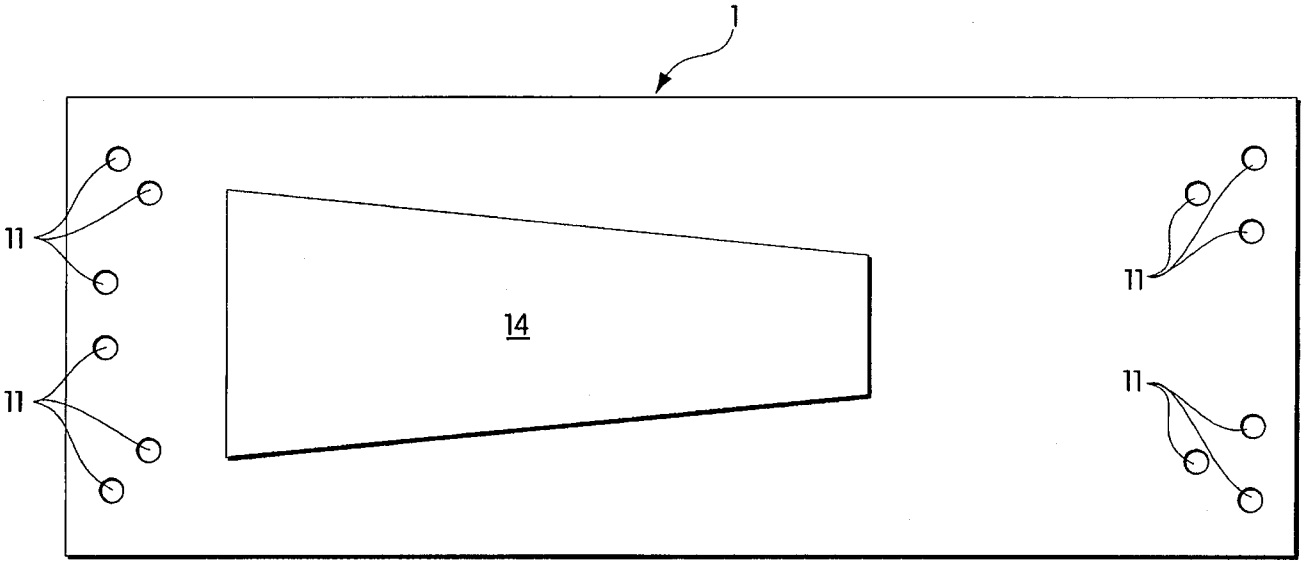
FIG. 5 is a perspective view, of the underside, of the primary tray.
Figure 4:
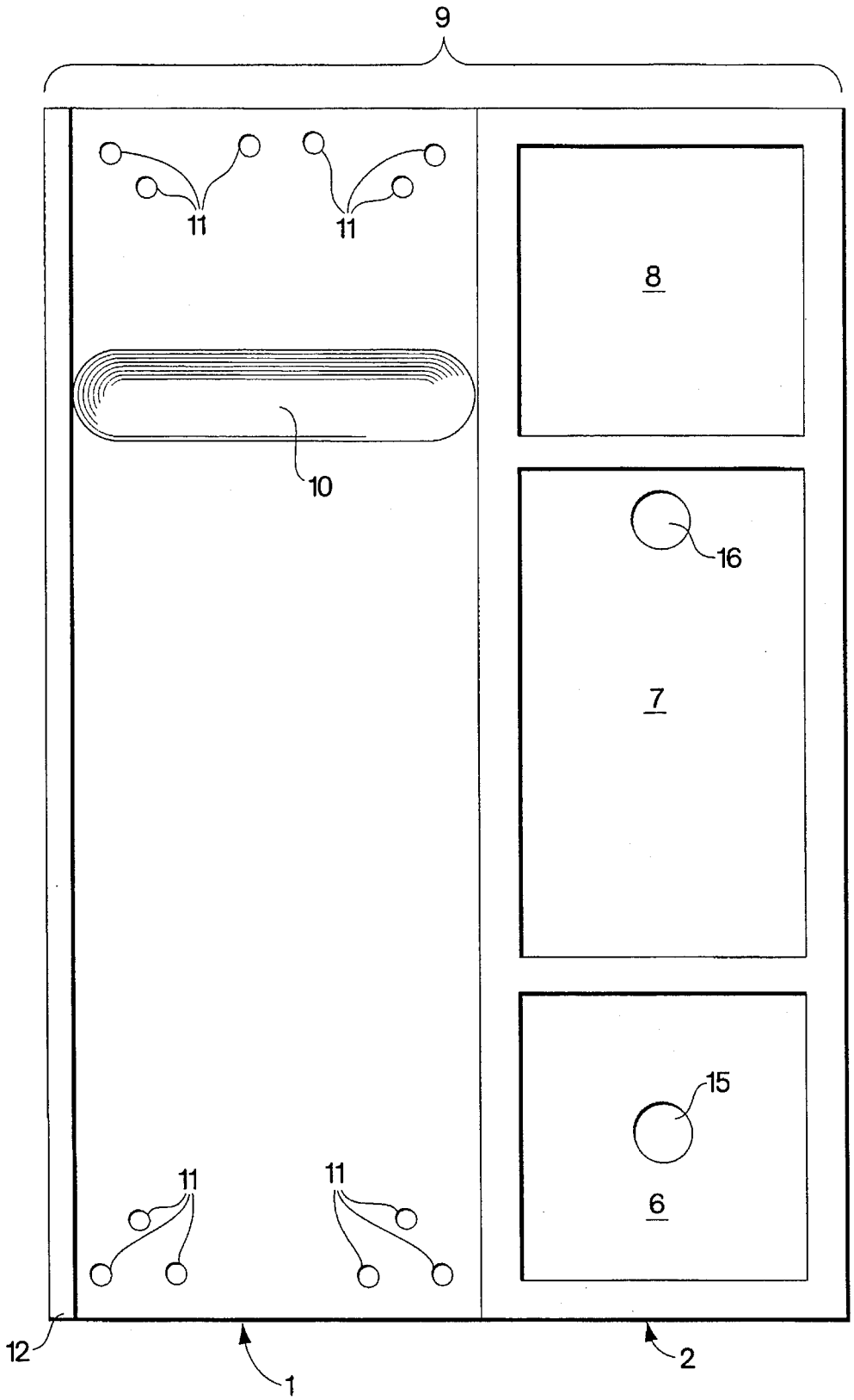
FIG. 4 is an aerial view of the platform, attached.

Referring now to the drawings, a device as shown in FIG. 1, constructed in accordance with the teachings of the present invention, is illustrated. The device FIG. 1 comprises a two-part platform 9, and a two-part, single legged, elongate support member 3. The two-part platform 9 consists of a primary tray 1, and a secondary tray 2. The structure and purpose of the primary tray 1, is to hold the foot of the user. One cavity 10, which intersects the length of primary tray 1, is the designated area for placement of the ball of the human foot. Perforations' 11 are present around the primary tray 1 perimeter, to allow residual water passage through the primary tray 1.

The secondary tray 2, of the two-part platform 9, possesses three receptacles 6,7,8 of different dimensions to hold applicable grooming needs. Although not exclusive, the preferred usage for the receptacles 6,7,8 is as follows. The first receptacle 6, is located nearest the heel of the foot of user, during use, and has one hole 15 in its center to hold a disposable razor. The second receptacle 7, has one hole 16 in its center and is located between the first 6 and third 8 receptacle. The purpose of the second receptacle 7, is to temporarily hold fresh water. The purpose of the third receptacle 8, which is located nearest the toes of the user while in use, is to hold shave gel, lotion, or soap, The primary tray 1 has raised sides 12 and the secondary tray 2 has an open wedge 13 on each of its opposing sides. These side features 12,13 on the primary 1 and secondary tray 2, allow the user of the present invention, to detach and join the primary tray 1 and the secondary tray 2.

The primary 1 and the secondary tray 2, both contain one standard hook, not shown, in the rear. This standard hook, is positioned in the rear side of each tray 1,2, which will allow each tray 1,2, to be hung for drying and storage.

A pocket 14 is formed underneath the platform 9, by sides extending away from tray 1. The pocket 14 allows the support member 3 to securely affix to the tray 1. The support member 3 divides with a rod 4, being the upper top portion of the support 3, and a base 5, being the bottom portion of support 3. The rod 4 has a narrower circumference than the base 5, which allows the rod 4 to slide into and fit securely inside the base 5. The surface underneath the base 5, houses multiple rubber feet, not shown, being made like suction cups, these rubber feet will provide secure adherence of the present invention FIG. 1, to shower or bath tub floor surfaces. While in use, the present invention figure I maintains a horizontal orientation.

The rod 4 contains three spaced holes' 4*x*, which pierces through the rod 4, and are located along its extended lower half. The base 5 contains one hole 5*x*, which pierces through the base 5, and is located along its extended upper half. These holes' 4*x*, 5*x* allow two height adjustment methods, to be adapted by the present invention FIG. 1.

One height adjustment method, which may be adapted to holes 4*x*, 5*x* in the support member 3, is as follows. As the rod 4 is extended into the base, a standard peg, not shown, may be inserted in the hole 5*x* of the support member 3. The rod 4 and the base 5 will be mated up as the peg is inserted through to any hole 4*x* in the rod 4. This peg will allow the user of the present invention FIG. 1, to join the rod 4 and the base 5 parts together, at the desired height.

Another height adjustment method, which may be adapted to support member 3, is as follows. A standard coil spring, not shown, having a peg bonded on each opposing end, may be placed inside the base 5 of the support member 3. As the rod 4 is extended down into the base 5, the pegs may be depressed, allowing rod 4 and base 5 to join. When the pegs are released, the spring will cause the peg to mate the rod 4 and base 5 together at the desired hole 4*x*.

While my detailed description contains many specificities, these should not be construed as limitations on the scope of the invention FIG. 1, but rather as an exemplification of one preferred embodiment of it. Many other variations are possible. The following are examples of such variations:

Perforations' 11 may be located anywhere in the two-part platform 9, thus to increase or decrease the rate of residual water flow;

The primary 1 and secondary tray 2, may be affixed by a standard clamp, or a standard screw;

Receptacles' 6,7,8 may be used to hold nail polish and other applicable supplies and needs for pedicures;

The two-part platform 9, may contain one or more receptacles' 6,7,8 with different dimensions and capabilities;

The support member 3 may contain more or fewer holes' 4*x*, 5*x;*

The support member 3 and/or the platform 1 may consist of one or more parts.

Accordingly, the scope of the invention FIG. 1 should be decided not by the embodiments illustrated, but by the appended claims and their legal equivalents.

What is claimed is:

1. A foot support device and grooming accessory holder comprising:

a platform having a foot support tray and an accessory holding tray, said foot support tray being mounted on top of a floor contacting support member, said support member being adjustable to vary the height at which said platform is supported above the floor, said foot support tray having a flat surface area bordered by an upstanding wall on two sides, said flat surface area being of a size to receive a user's foot and having a cavity to receive the ball of the user's foot as well as holes to drain water from said flat surface area, said accessory tray comprising a first, second and third receptacle with an elongated receiving area on either side of said first, second and third receptacles, each of said receiving areas being sized and shaped to receive either of said upstanding walls in a close fit such that said accessory tray can be supported by either of said walls so as to be positioned adjacent said foot support tray to house grooming accessory articles;

said support member having a plurality of friction feet thereon to engage a floor to prevent said platform from moving while in use.

* * * * *